US008011959B1

(12) United States Patent
Tsai et al.

(10) Patent No.: US 8,011,959 B1
(45) Date of Patent: Sep. 6, 2011

(54) HIGH FREQUENCY MICRO CONNECTOR

(75) Inventors: Cheng-Yung Tsai, Hsin-Tien (TW); Ming-Yung Chang, Hsin-Tien (TW)

(73) Assignee: Advanced Connectek Inc., Hsin-Tien (TW)

( * ) Notice: Subject to any disclaimer, the term of this patent is extended or adjusted under 35 U.S.C. 154(b) by 0 days.

(21) Appl. No.: 12/853,416

(22) Filed: Aug. 10, 2010

(30) Foreign Application Priority Data

May 19, 2010 (TW) ..... 99209383 U

(51) Int. Cl.
*H01R 25/00* (2006.01)

(52) U.S. Cl. ..... 439/607.25; 439/607.24; 439/541.5

(58) Field of Classification Search ..... 439/541.5, 439/607.23–607.25
See application file for complete search history.

(56) References Cited

U.S. PATENT DOCUMENTS 5,518,421 A * 5/1996 Davis ..... 439/607.5
6,238,244 B1 * 5/2001 Yang ..... 439/607.01
6,309,227 B1 * 10/2001 Chen et al. ..... 439/79
6,319,061 B1 * 11/2001 Chen et al. ..... 439/607.15
7,052,292 B2 * 5/2006 Hsu et al. ..... 439/98
7,311,556 B2 * 12/2007 Wan et al. ..... 439/607.32
7,465,194 B1 * 12/2008 Ho et al. ..... 439/607.01
7,753,724 B2 * 7/2010 Gong et al. ..... 439/541.5
7,762,840 B2 * 7/2010 Hamner et al. ..... 439/541.5
7,771,237 B2 * 8/2010 Lei et al. ..... 439/607.54
7,785,140 B2 * 8/2010 Henry ..... 439/541.5
2009/0318026 A1 * 12/2009 Yi et al. ..... 439/607.24

* cited by examiner

*Primary Examiner* — Briggitte R Hammond
(74) *Attorney, Agent, or Firm* — Bacon & Thomas, PLLC

(57) ABSTRACT

A high frequency micro connector has an insulating housing, multiple first terminals and multiple terminals. The insulating housing has a base, a first tongue and a second tongue. The first and second terminals are mounted through the base respectively on the first and second tongue. The second tongue includes pairs of high frequency signal transmission terminals each having a transverse extension section and a soldering section formed on the transverse extension section. The transverse extension sections of each pair protrude reversely and oppositely to increase the distance between the soldering sections therefore to prevent crosstalk between the high frequency signal transmission terminals.

19 Claims, 9 Drawing Sheets

HIGH FREQUENCY MICRO CONNECTOR

BACKGROUND OF THE INVENTION

1. Field of the Invention

The present invention relates to a connector, and more particularly to a high frequency micro connector that has pairs of signal transmission terminals and the signal transmission terminals of each pair are staggered to prevent crosstalk between the signal transmission terminals.

2. Description of Related Art

Conventional Universal Serial Bus (USB) 2.0 connectors are used popularly in various electronic devices. Most of computer peripherals are equipped with USB connectors. Because electronic devices are constantly developed to increase transmission speed thereof, the USB 2.0 protocol does not meet the current transmission speed requirement of new electronic devices. Therefore, the USB Implementers Forum sets forth new USB 3.0 protocol for higher data transmission speed.

The USB 3.0 protocol is compatible with the USB 2.0 protocol and provides theoretical 5 Gbps of data transmission speed.

However, a USB 3.0 connector has two rows of terminals for implementing USB 2.0 or 3.0 protocol alternatively so that the USB 3.0 receptacle connector has a large size and complicated structures to increase the molding design cost and manufacturing cost. Furthermore, the USB 3.0 receptacle connector easily fails the high frequency data transmission due to crosstalk between high frequency signal transmission terminals.

Moreover, for the compatibility with USB 2.0 protocol, the USB 3.0 connector includes Micro-B type. Micro-B type USB 3.0 connectors are designed for portable electronic devices such as cellular phones so are smaller than standard A type USB connectors. Therefore, the arrangement of terminals on the Micro-B type is tighter and more compact when compared to those of standard A type connector, which causes crosstalk easily.

To overcome the shortcomings, the present invention provides a high frequency micro connector to mitigate or obviate the aforementioned problems.

SUMMARY OF THE INVENTION

The main objective of the invention is to provide a high frequency micro connector that has pairs of signal transmission terminals and the signal transmission terminals of each pair are staggered to prevent crosstalk between the signal transmission terminals.

A high frequency micro connector in accordance with the present invention comprises an insulating housing, multiple first terminals and multiple terminals. The insulating housing has a base, a first tongue and a second tongue. The first and second terminals are mounted through the base respectively on the first and second tongue. The second tongue includes pairs of high frequency signal transmission terminals each having a transverse extension section and a soldering section formed on the transverse extension section. The transverse extension sections of each pair protrude reversely and oppositely to increase the distance between the soldering sections therefore to prevent crosstalk between the high frequency signal transmission terminals.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1 to 4, a high frequency micro connector in accordance with the present invention may be mounted on a cable and may comply with the USB 3.0 Micro-B type plug connector standard. The USB 3.0 Micro-B type standard is described in section 5.34 "USB 3.0 Micro Connector Family" of the USB 3.0 specification that is published on the USB implementers Forum (USB IF) website "http://www.usb.org/home", which is incorporated herein for reference.

Figure 1:
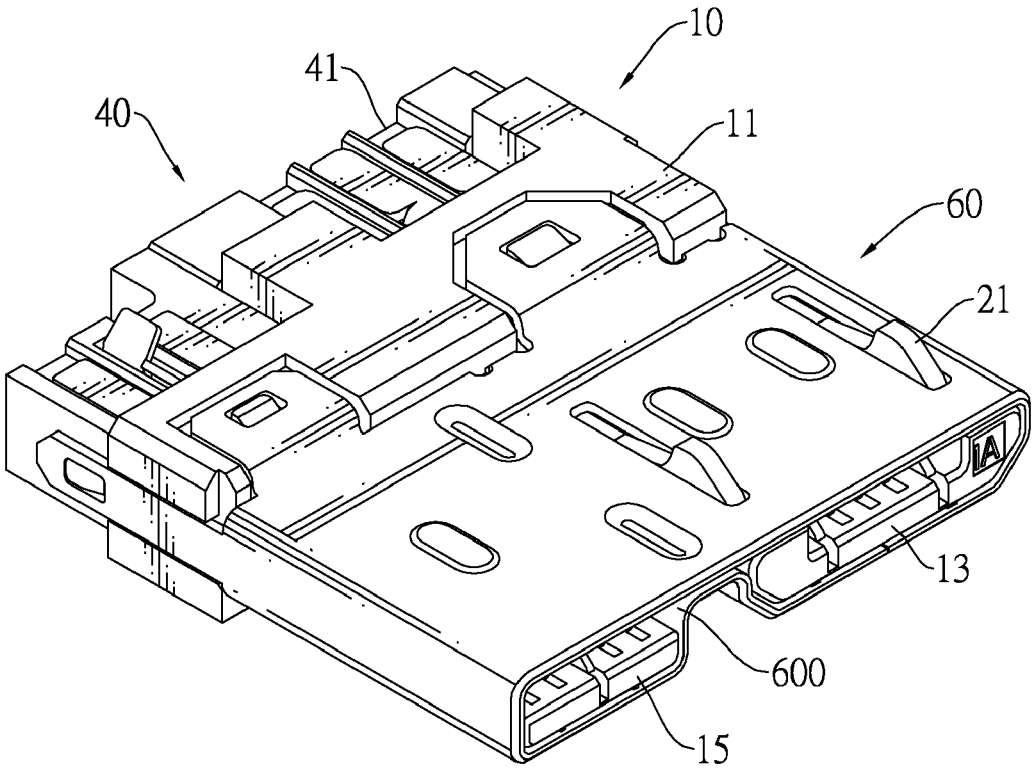
FIG. 1 is a front perspective view of a high frequency micro connector in accordance with the present invention.
Figure 2:
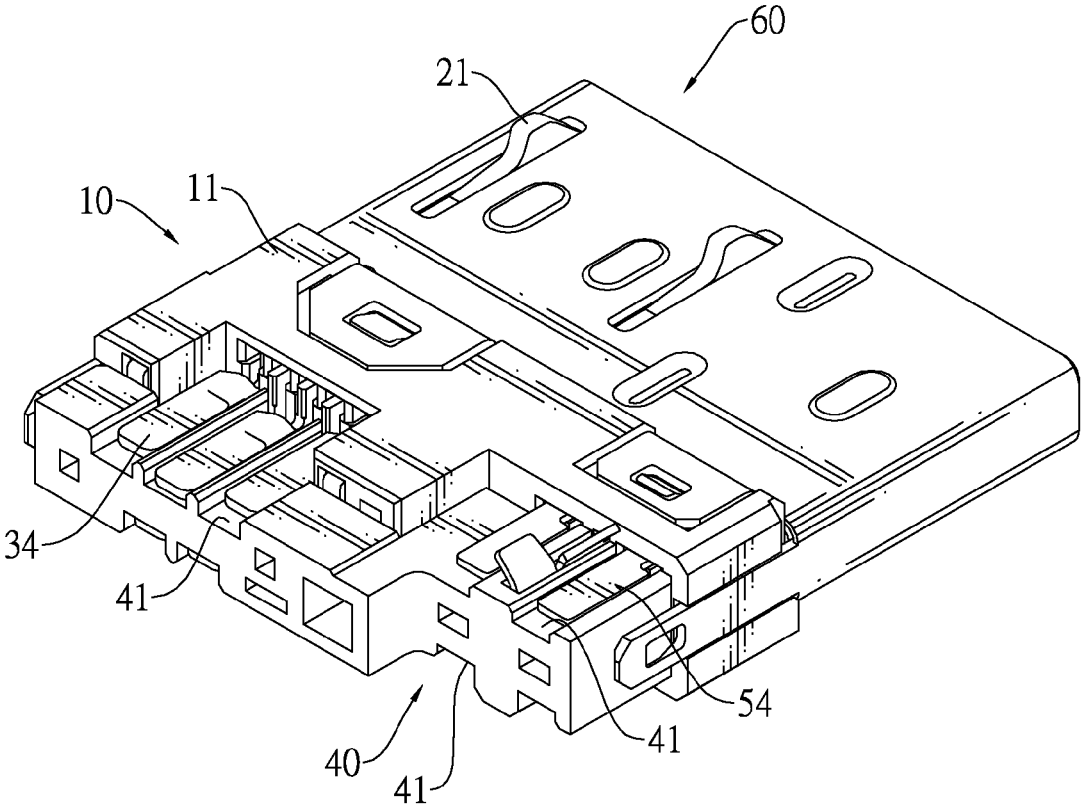
FIG. 2 is a rear perspective view of the high frequency micro connector in FIG. 1.
Figure 3:
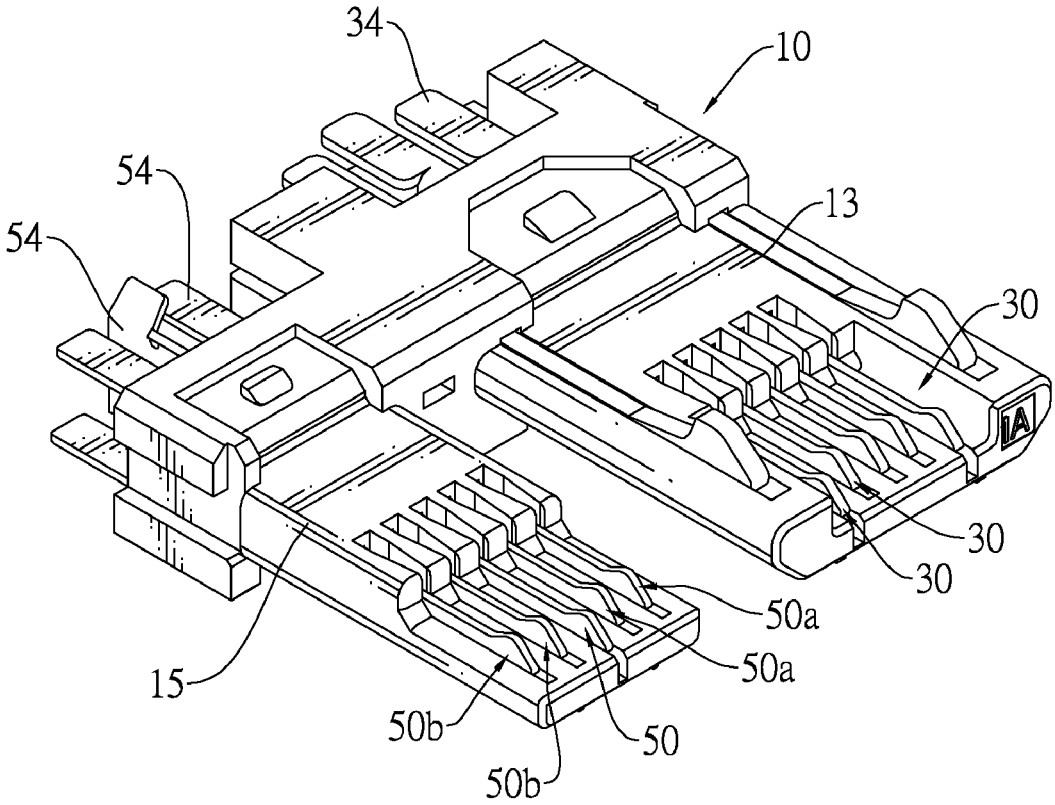
FIG. 3 is a front perspective view of the high frequency micro connector omitting the shell.
Figure 4:
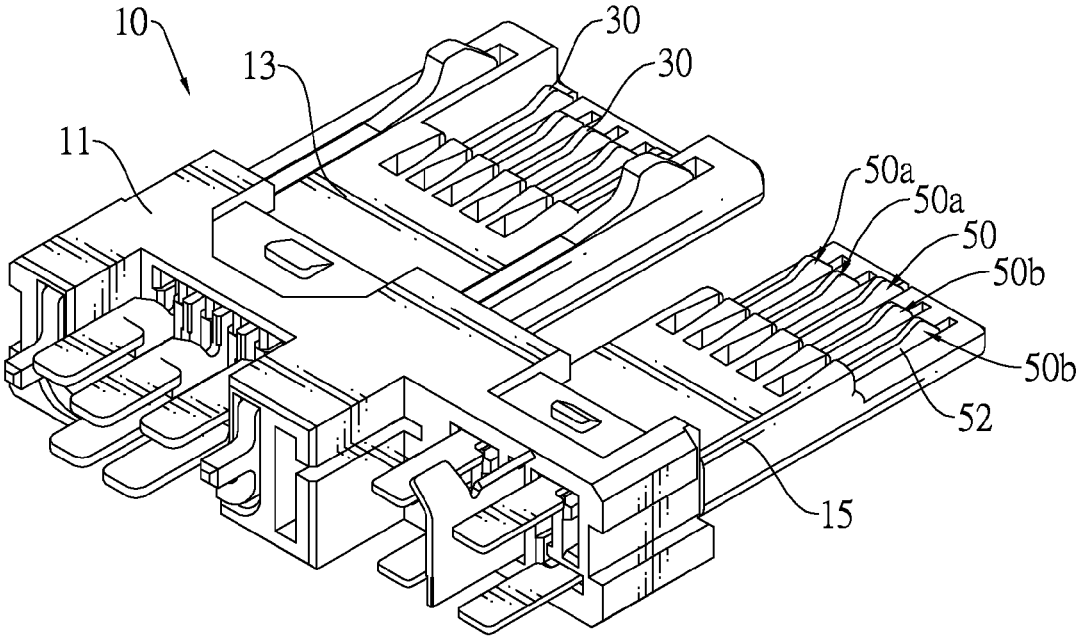
FIG. 4 is a rear perspective view of the high frequency micro connector omitting the shell.
Figure 5:
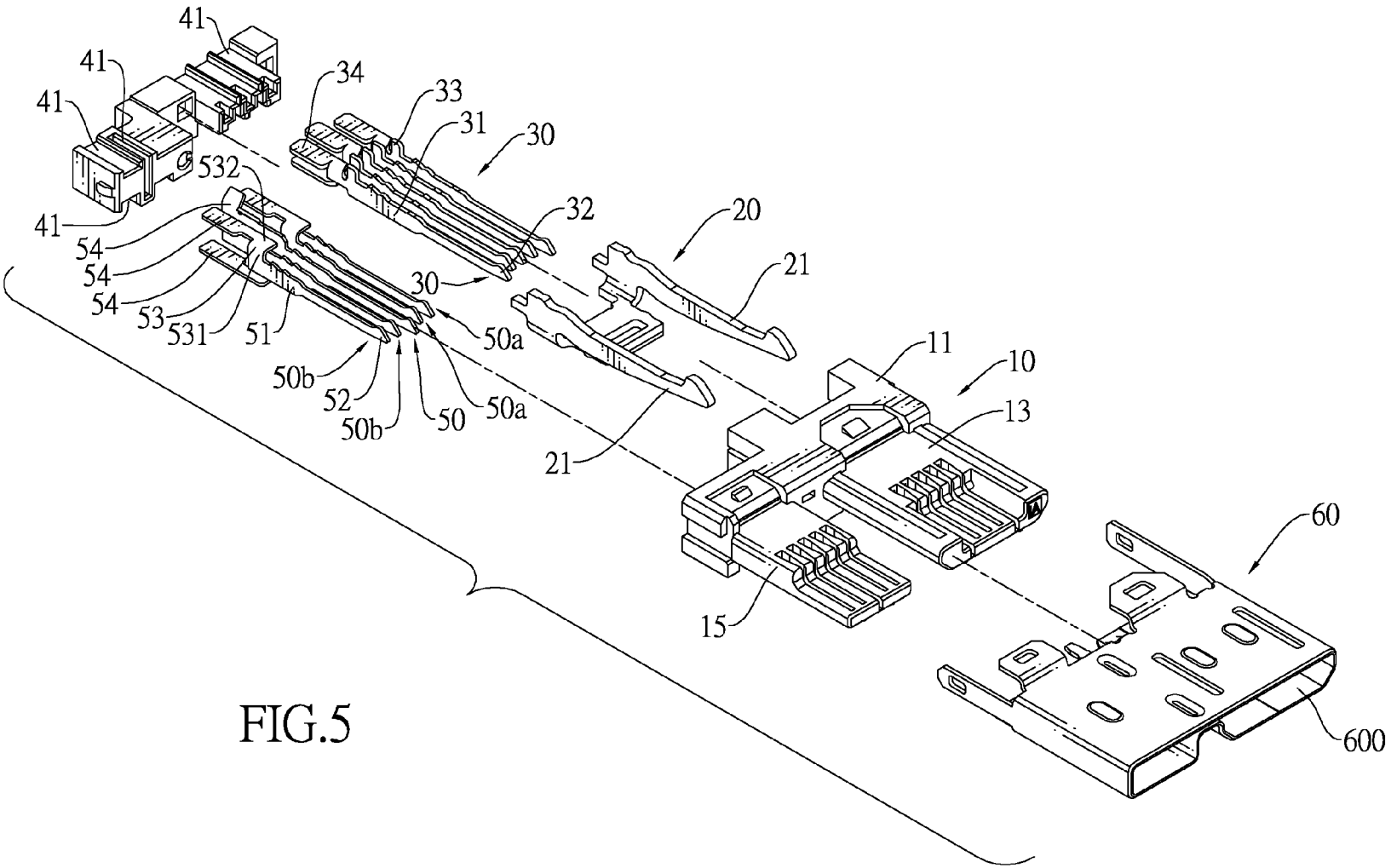
FIG. 5 is an exploded front perspective view of the high frequency micro connector in FIG. 1.
Figure 6:
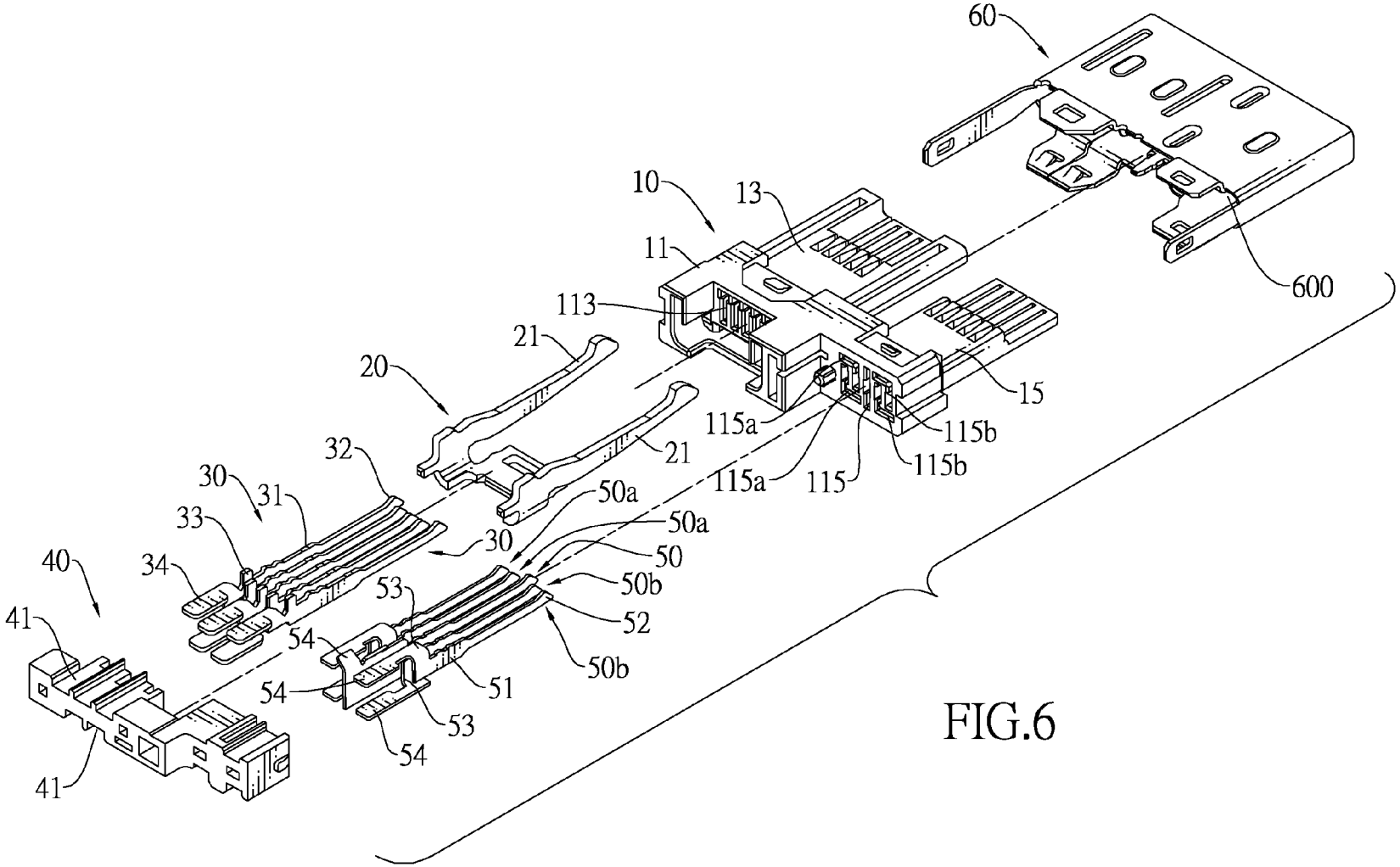
FIG. 6 is an exploded rear perspective view of the high frequency micro connector in FIG. 2.

With further reference to FIGS. 5 and 6, the high frequency micro connector comprises an insulating housing (10), multiple first terminals (30), multiple second terminals (50, 50*a*, 50*b*), a fastener (20), a mounting bracket (40) and a shell (60).

The insulating housing (10) has a base (11), a first tongue (13), a second tongue (15), multiple first mounting holes (113) and multiple second mounting holes (115, 115*a*, 115*b*).

The base (11) has a front and a rear

The first tongue (13) and the second tongue (15) are formed on and protrude forward from the front of the base (11) and are arranged abreast transversely.

The first mounting holes (113) are defined through the base (11) and may extend in the first tongue (13). Each first mounting hole (113) has an inner surface.

The second mounting holes (115, 115*a*, 115*b*) are defined through the base (11) and may extend in the second tongue (15). Each second mounting hole (115, 115*a*, 115*b*) has an inner surface. Several of the second mounting holes (115, 115*a*, 115*b*) are arranged in pairs. Each second mounting hole (115*a*, 115*b*) of each pair has an L-shaped cross section adjacent to the rear of the base (11).

The first terminals (30) are formed on and protrude forward from the base (11), are mounted respectively through and correspond to the first mounting holes (113) in the base (11), are mounted on the first tongue (13) of the insulating housing (10) and are capable of implementing USB 2.0 protocol. Each first terminal (30) has a first mounting section (31), a first contacting section (32) and a first soldering section (34) and may further have a stopper (33).

The first mounting section (31) is mounted in a corresponding first mounting hole (113) in the base (11) of the insulating housing (10).

The first contacting section (32) is formed on and protrudes forward from the first mounting section (31) and is mounted on the first tongue (13).

The first soldering section (34) is formed on and protrudes backward from the first mounting section (31).

The stopper (33) is formed on and protrudes upward from the first mounting section (31) and abuts the inner surface of the corresponding first mounting hole (113) to prevent the first terminal (30) from inadvertently moving forward and falling out of the insulating housing (10).

Figure 7:
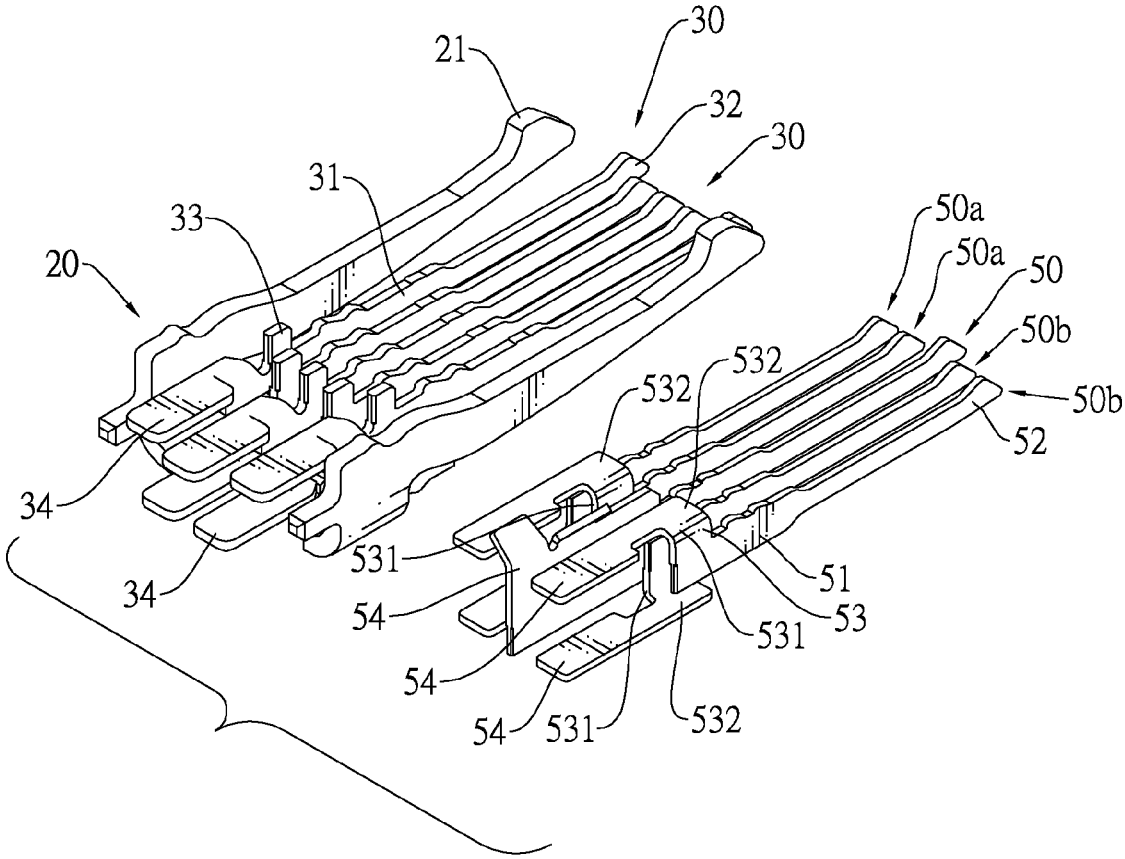
FIG. 7 is a perspective view of the first and second terminals of the high frequency micro connector in FIG. 2.
Figure 8:
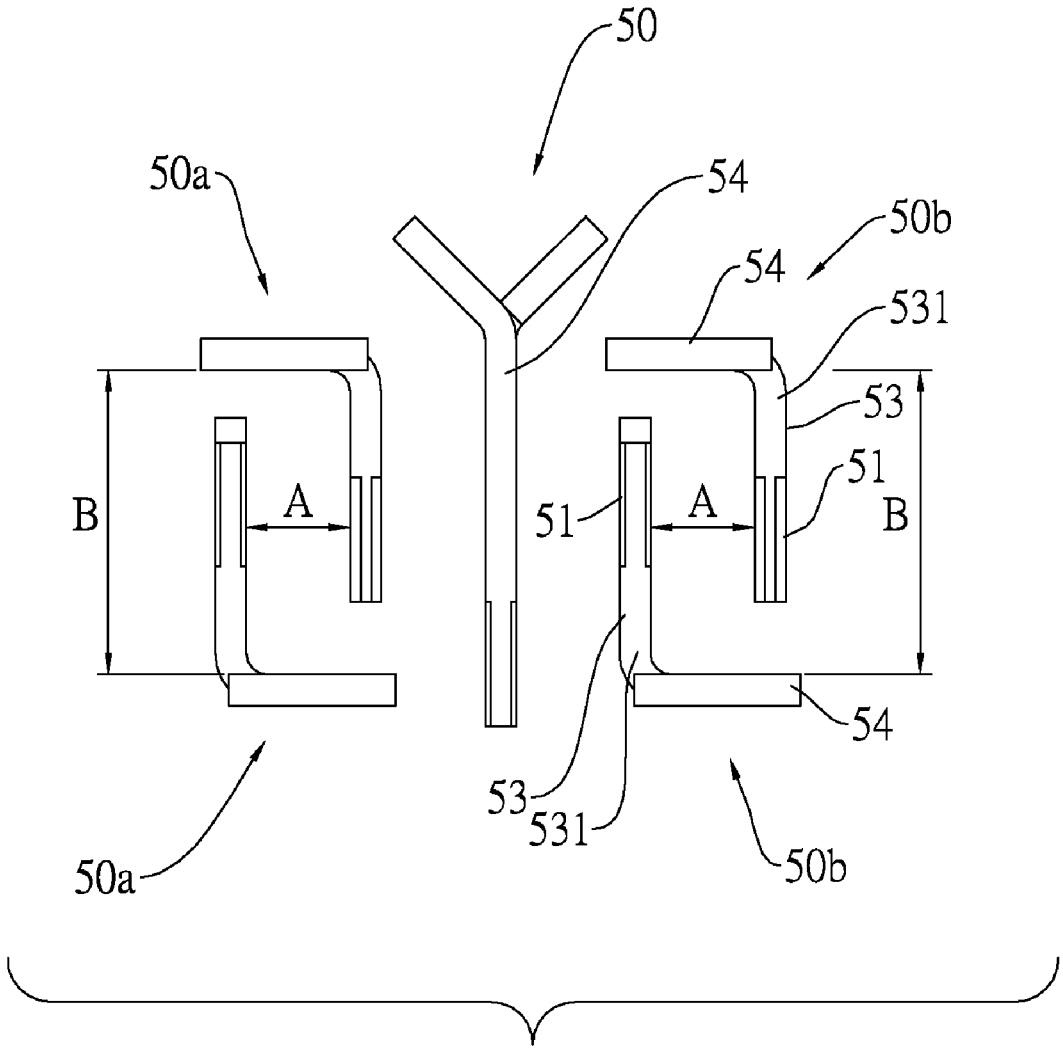
FIG. 8 is a rear view of the first and second terminals of the high frequency micro connector in FIG. 7.
Figure 9:
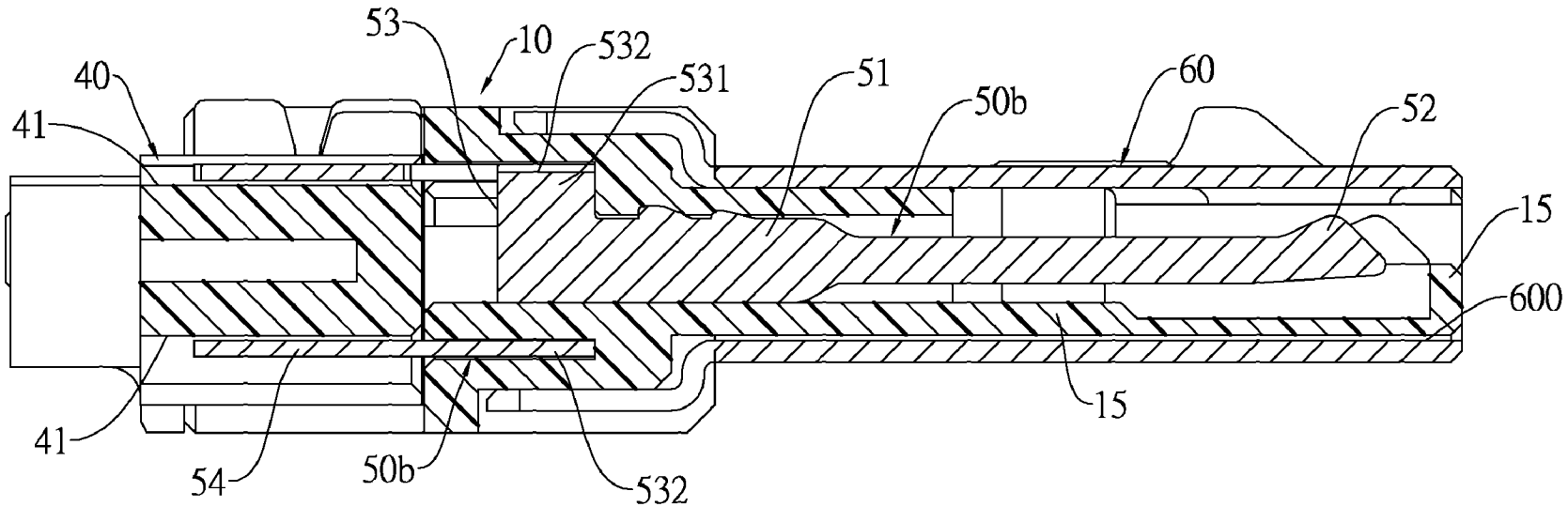
FIG. 9 is a cross sectional side view of the high frequency micro connector in FIG. 1.

With further reference to FIGS. 7 to 9, the second terminals (50, 50*a*, 50*b*) are formed on and protrude forward from the base (11), are mounted respectively through and correspond to the second mounting holes (115, 15*a*, 115*b*) in the base (11), are mounted on the second tongue (15) of the insulating housing (10) and are capable of cooperating with the first terminals (30) to implement USB 3.0 protocol. The second terminals (50, 50*a*, 50*b*) include pairs of high frequency signal transmission terminals (50*a*, 50*b*) such as super-speed transmitter terminals and super-speed receiver terminals defined in the aforementioned USB 3.0 specification of the USB IF. The pairs of the high frequency signal transmission terminals (50*a*, 50*b*) may correspond to the pairs of the second mounting holes (115*a*, 115*b*). The high frequency signal transmission terminals (50*a*, 50*b*) of each pair are arranged adjacent to each other and each frequency signal transmission terminal (50*a*, 50*b*) has a second mounting section (51), a second contacting section (52), a transverse extension section (53) and a second soldering section (54).

The second mounting section (51) is mounted in a corresponding second mounting hole (115*a*, 115*b*) in the base (11) of the insulating housing (10).

The second contacting section (52) is formed on and protrudes forward from the second mounting section (51) and is mounted on the second tongue (15).

The transverse extension section (53) is formed on and protrudes transversely from the second mounting section (51), may be L-shaped and match the L-shaped cross section of a corresponding second mounting hole (115*a*, 115*b*). The transverse extension section (53) may have a vertical tab (531) and a horizontal tab (532). The vertical tab (531) protrudes upward or downward from the second mounting section (51). The horizontal tab (532) protrudes inward or outward from the vertical tab (531). Preferably, in each pair of the high frequency signal transmission terminals (50*a*, 50*b*), one high frequency signal transmission terminal (50*a*, 50*b*) has the vertical tab (531) protruding upward and the horizontal tab (532) protruding inward. The other high frequency signal transmission terminal (50*a*, 50*b*) has the vertical tab (531) protruding inward and the horizontal tab (532) protruding outward, as shown in FIGS. 8 and 9.

Furthermore, the transverse extension section (53) of each high frequency transmission terminal (50*a*, 50*b*) serves as a stopping element to abut the inner surface of the corresponding second mounting hole (115*a*, 115*b*) to prevent the high frequency transmission terminal (50*a*, 50*b*) from inadvertently moving forward and falling out of the insulating housing (10).

The second soldering section (54) is formed on and protrudes backward from the transverse extension section (53).

Furthermore, the transverse extension sections (53) of the high frequency transmission terminals (50*a*, 50*b*) of each pair protrude reversely and oppositely to make a distance (B) between the second soldering sections (54) larger than a distance (A) between the second mounting sections (51). The transverse extension tabs (53) increase the distance (B) between the second soldering sections (54) to reduce the crosstalk between the high frequency transmission terminals (50*a*, 50*b*) of each pair.

Preferably, the second terminals (50, 50*a*, 50*b*) are classified into two pairs of high frequency transmission terminals (50*a*, 50*b*) and a grounding terminal (50) between the pairs. The grounding terminal (50) has a second mounting section (51), a second contacting section (52) and a second soldering section (54). The second contacting section (52) is formed on and protrudes forward from the second mounting section (51). The second soldering section (54) is formed on and protrudes backward from the second mounting section (51).

The fastener (20) is mounted through the base (11) of the insulating housing (10) and has two resilient hooks (21). The resilient hooks (21) are formed on and protrude forward from the fastener (20), are mounted on the first tongue (13) and may hook in a socket hole of a corresponding receptacle connector such as a USB 2.0/3.0 socket connector to prevent inadvertent disconnection between the plug and receptacle connectors.

The mounting bracket (40) is mounted on the rear of the base (11) of the insulating housing (10) and has a top surface, a bottom surface and two sets of positioning recesses (41). The sets of positioning recesses (41) are defined respectively in the top surface and the bottom surface. The positioning recesses (41) of the sets respectively hold the first and second soldering sections (34, 54) of the first and second terminals (30, 520, 50*a*, 50*b*) and facilitate the soldering processes that applies tin solder to the first and second soldering sections (34, 54) to connect to corresponding wires of a cable.

The shell (60) covers the insulating housing (10), first terminals (30), second terminals (50, 50*a*, 50*b*), may engage with the mounting bracket (40) and has a cavity (600) accommodating the insulating housing (10), first terminals (30) and second terminals (50, 50*a*, 50*b*).

The transverse extension tabs (53) increase the distance (B) between the second soldering sections (54) when compared to a conventional Micro-B type plug connector. The increased distance (B) effectively reduces the crosstalk between the high frequency transmission terminals (50*a*, 50*b*) of each pair.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A high frequency micro connector comprising:

an insulating housing having a base having a front and a rear;

a first tongue formed on and protruding forward from the front of the base; and a second tongue formed on and protruding forward from the front of the base;

multiple first terminals mounted through the base and mounted on the first tongue of the insulating housing;

multiple second terminals mounted through the base and mounted on the second tongue of the insulating housing, being capable of cooperating with the first terminals to implement USB 3.0 protocol, the second terminals including pairs of high frequency signal transmission terminals, the high frequency signal transmission terminals of each pair arranged adjacent to each other and each high frequency signal transmission terminal having a mounting section mounted in the base;

a contacting section formed on and protruding forward from the mounting section and mounted on the second tongue;

a transverse extension section formed on and protruding transversely from the mounting section; and a soldering section formed on and protruding backwardly from the transverse extension section;

wherein the transverse extension sections of the high frequency transmission terminals of each pair protrude reversely and oppositely to make a distance between the soldering sections larger than a distance between the mounting sections of the high frequency transmission terminals of each pair; and a shell covering the insulating housing, the first terminals and the second terminals.

2. The high frequency micro connector as claimed in claim 1, wherein each first terminal has a first mounting section mounted in the base;

a first contacting section formed on and protruding from the first mounting section;

a first soldering section formed on and protruding from the first mounting section; and the mounting section, the contacting section and the soldering section of each high frequency transmission terminal are respectively a second mounting section, a second contacting section and a second soldering section.

3. The high frequency micro connector as claimed in claim 2, wherein the transverse extension of each high frequency signal transmission terminal is L-shaped and has a vertical tab protruding upward or downward from the second mounting section; and a horizontal tab protruding inward or outward from the vertical tab; and the second soldering section of each high frequency signal transmission terminal is formed on and protrudes backward from the horizontal tab.

4. The high frequency micro connector as claimed in claim 3, wherein in each pair of the high frequency signal transmission terminals, one of the high frequency signal transmission terminal has the vertical tab protruding upward and the horizontal tab protruding inward, the other high frequency signal transmission terminal has the vertical tab protruding inward and the horizontal tab protruding outward.

5. The high frequency micro connector as claimed in claim 3, wherein the insulating housing further has multiple first mounting holes defined through the base, respectively receiving the first terminals and each first mounting hole having an inner surface; and multiple second mounting holes defined through the base, respectively receiving the second terminals and each second mounting hole having an inner surface;

wherein several of the second mounting holes are arranged in pairs to correspond to the pairs of the high frequency signal transmission terminals and each second mounting hole of each pair has an L-shaped cross section matching the transverse extension section of one of the high frequency signal transmission terminals.

6. The high frequency micro connector as claimed in claim 5, wherein the second terminals are classified into two pairs of high frequency signal transmission terminals and a grounding terminal arranged between the pairs of high frequency signal transmission terminals.

7. The high frequency micro connector as claimed in claim 5, wherein the transverse extension section of each high frequency transmission terminal serves as a stopping element abutting the inner surface of a corresponding second mounting hole of the base.

8. The high frequency micro connector as claimed in claim 5, wherein each first terminal further has a stopper formed on and protruding upward from the first mounting section and abutting the inner surface of a corresponding first mounting hole of the base.

9. The high frequency micro connector as claimed in claim 8 further comprising a fastener mounted through the base of the insulating housing and having two resilient hooks formed on and protruding forward from the fastener and mounted on the first tongue.

10. The high frequency micro connector as claimed in claim 8 further comprising a mounting bracket mounted on the rear of the base of the insulating housing and having a top surface;

a bottom surface; and two sets of positioning recesses defined respectively in the top surface and the bottom surface and the positioning recesses of the sets respectively holding the first and second soldering sections of the first and second terminals.

11. The high frequency micro connector as claimed in claim 8, wherein the first terminals are capable of implementing USB 2.0 protocol.

12. The high frequency micro connector as claimed in claim 1, wherein the high frequency micro connector complies with the USB 3.0 Micro-B type plug connector standard.

13. The high frequency micro connector as claimed in claim 2, wherein the high frequency micro connector complies with the USB 3.0 Micro-B type plug connector standard.

14. The high frequency micro connector as claimed in claim 3, wherein the high frequency micro connector complies with the USB 3.0 Micro-B type plug connector standard.

15. The high frequency micro connector as claimed in claim 4, wherein the high frequency micro connector complies with the USB 3.0 Micro-B type plug connector standard.

16. The high frequency micro connector as claimed in claim 5, wherein the high frequency micro connector complies with the USB 3.0 Micro-B type plug connector standard.

17. The high frequency micro connector as claimed in claim 6, wherein the high frequency micro connector complies with the USB 3.0 Micro-B type plug connector standard.

18. The high frequency micro connector as claimed in claim 7, wherein the high frequency micro connector complies with the USB 3.0 Micro-B type plug connector standard.

19. The high frequency micro connector as claimed in claim 8, wherein the high frequency micro connector complies with the USB 3.0 Micro-B type plug connector standard.

* * * * *